US005542221A

United States Patent [19]

Streit et al.

[11] Patent Number: 5,542,221

[45] Date of Patent: Aug. 6, 1996

[54] DUAL STIFFNESS FLOORING

[75] Inventors: Donald A. Streit; Joe Casalena; Tim Ovaert, all of State College, Pa.

[73] Assignee: The Penn State Research Foundation, University Park, Pa.

[21] Appl. No.: 237,751

[22] Filed: May 4, 1994

[51] Int. Cl.[6] ..... E04F 15/22

[52] U.S. Cl. ..... 52/403.1; 52/177; 404/33; 404/38; 472/92

[58] Field of Search ..... 52/403.1, 177, 52/263, 390, 480; 404/32.33, 38; 472/92

[56] References Cited

U.S. PATENT DOCUMENTS

| | | | |
|---|---|---|---|
| 2,737,693 | 3/1956 | Robbins | 428/81 X |
| 3,636,577 | 1/1972 | Nissen . | |
| 4,557,475 | 12/1985 | Donovan . | |
| 4,694,627 | 9/1987 | Ornholt | 52/403.1 X |
| 4,727,697 | 3/1988 | Vaux . | |
| 4,846,457 | 7/1989 | Vaux . | |
| 4,860,510 | 8/1989 | Kotler | 52/177 |
| 4,948,116 | 8/1990 | Vaux . | |
| 4,991,834 | 2/1991 | Vaux . | |
| 4,998,717 | 3/1991 | Vaux . | |
| 5,228,253 | 7/1993 | Wahelez | 52/177 |
| 5,234,738 | 8/1993 | Wolf | 52/177 X |
| 5,403,637 | 4/1995 | Pickard et al. | 52/177 X |

*Primary Examiner*—Carl D. Friedman
*Assistant Examiner*—Robert J. Canfield
*Attorney, Agent, or Firm*—Thomas J. Monahan

[57] ABSTRACT

An impact-absorbing flooring system of modular design is described, with applications in areas of nursing homes where there is a high risk of injury due to falls or in sports facilities for high impact events such as gymnastics and tumbling or with other uses. For example, the invention could also take the form of a safety mat or coaming for use around slippery areas like bathtubs, showers or the edge of swimming pools. The system provides a significant reduction in peak impact load during falls, yet retains a substantially non-compliant configuration during normal motions. The flooring system comprises a series of sections or tiles which can be interconnected to cover the high-risk area. Each tile is composed of a plurality of elastomeric columns sandwiched between two urethane sheets. The top sheet and projecting columns are preferably molded as one piece and then the lower sheet is secured about the free ends of the columns to produce a secure attachment and an integrated unit. The exposed face of the top sheet may optionally be coated with a thin layer of high-friction material and the non-slip properties could be enhanced by incorporation of a knurl pattern.

10 Claims, 4 Drawing Sheets

DUAL STIFFNESS FLOORING

BACKGROUND OF THE INVENTION

The present invention relates generally to impact-absorbing covering for traffic-carrying surfaces. More particularly, this invention relates to static structures having two area moments of inertia so that they can effectively absorb impact during falls but remain substantially rigid under normal loading.

By way of background, falls represent the leading cause of non-fatal injuries in the United States (Cost of Injury, 1989). In 1985, falls accounted for an estimated 21% of non-hospitalized injured persons (11.5 million people) and 33% of hospitalized injured persons (783,000 hospitalizations). In addition 9% of fatalities (12,866 deaths) were related to falls.

A number of epidemiological studies report a drastic increase of fall incidence rate in the elderly population over the age of 65, suggesting a direct relationship between aging and the frequency of fall events (Sorock, 1988; Healthy People 2000, 1990; Injury Prevention: Meeting the Challenge, 1989; National Safety Council, 1990; Grisso et al., 1990; DeVito et al., 1988; Waller, 1985; Waller, 1978; Sattin et at., 1990). In the age group above 65, the exact incidence of non-fatal falls is difficult to determine, but it has been estimated that approximately 30% of all individuals over the age of 65 have at least one fall per year (Sorock, 1988).

This represents a significant health problem when one considers the dramatic growth in the number of people over 65 and their proportion in the population. This age group currently makes up 12.5% of the U.S. population with projected increases to 19.5% by the year 2025 (A Profile of Older Americans: 1990, 1990). Of particular note is the growth of the "oldest old", those people over 75. In the decade between 1990 and 2000, the greatest growth in the over 55 age group will be among the 75 and older—an increase of 26.2 percent or a gain of nearly 4.5 million (U.S. Dept. of Commerce, Bureau of Census, 1988).

It was stated in Injury in America (1985, p. 43) that "Almost no current research deals with the mechanisms and prevention of injury from falls (the leading cause of non-fatal injury) . . . Little is known about the effectiveness of energy-absorbing materials, either worn by persons at high risk or incorporated in the surfaces onto which they fall".

Current approaches to solving the problem of injury from falls can be separated into two broad categories. The first category includes a harness device which is worn by the subject and tethered to a ceiling mounted track. If a person falls, the device lowers them to the ground in a controlled manner. While preliminary results have proven the system successful, it does have a number of drawbacks. The device must be worn by all potential fall victims to be effective and may require extensive modification of the existing architecture for the system to work between rooms.

Other devices in this category are either active or passive systems worn on critical impact regions of the body. The active system senses a fall and inflates air bags around the hips and knees while the passive devices employ an air bag or pad strapped to the hip region. Unfortunately these approaches only offer protection to the targeted areas and typically hands, wrists etc. will be unprotected during forward falls. A major disadvantage of all the devices in this first category is that they require significant effort on the part of the user and it is widely accepted that as the amount of individual effort required increases, the proportion of the population who will properly apply the system decreases (Injury in America, 1985).

The second category covers devices which use composite matting to absorb energy resulting from patient/floor impact during falls. U.S. Pat. Nos. 3,636,577, 4,557,475, 4,727,697, 4,846,457, 4,948,116, 4,991,834 and 4,998,717, all describe impact absorbing coverings which utilize air-filled cells or compressible materials to absorb the energy of a fall. Because these systems must be compliant to absorb energy, shoe/foot contact results in relatively large mat deflections under normal locomotion. This has the potential to increase the likelihood of falls due to toe/mat interference during foot swing. This factor would be greatly magnified in a nursing home setting, where many residents have an unsteady gait.

The present invention overcomes the above-described disadvantages inherent with various apparatuses and methods of the prior art. The invention presents a flooring system which requires no special clothing or restriction of movement since the floor will act as the injury prevention system. The design incorporates dually stiff flooring which would remain rigid under normal locomotion and would only deflect under impact loading. This approach offers a novel and effective system to reduce injuries from falls without leading to an increase in the fall rate.

SUMMARY OF THE INVENTION

The flooring system of the invention consists of a plurality of substantially uniform columns, preferably of urethane, which are sandwiched between two flexible urethane plates. The columns are affixed to the plates and are arranged in an orthogonal configuration. The entire device of the invention, or separate components thereof, are amenable to manufacture by moldings.

The geometry of each individual column is such that in top plan view, it has a thick and a thin dimension e.g. a rectangle. Associated with these two dimensions are two separate area moments of inertia. The greater and lesser area moments of inertia are referred to as the major and minor area moments of inertia respectively. The stiffness of the column in a particular direction is directly proportional to its associated area moments of inertia and generally greater rigidity is achieved in the direction corresponding to the thicker dimension. In practical terms this means that if a load is applied to the top of a fixed column it will tend to buckle first in the direction in which it is thinner.

In order to maintain lateral stability in both directions, each of the columns has been arranged preferably orthogonally to its adjacent neighbors and the beams have been attached at their endpoints to flexible plates. The result of this arrangement is that the lateral stability and buckling design problems have been decoupled. Lateral stiffness in both directions is now dominated by the major area moment of inertia while the buckling load (which is critical to the impact-absorbing performance) is determined by the minor area moment of inertia. This innovative design supports subject weight before impact, is stable laterally during normal locomotion, but buckles to reduce peak subject loading upon impact.

The invention is preferably modular in design, in one embodiment taking the form of interconnecting tiles. The modular tiles of the invention are preferably square and may be interlocked by means of joints molded into the edges of the upper plate of the tile, with two adjacent sides having a male joint and the other two adjacent sides having a female joint. Other mechanical or chemical connecting means known in the art may also be employed.

OBJECT OF THE INVENTION

An object of this invention is to develop a system useful in reducing injuries from falls.

It is also an object of the invention to develop a flooring system capable of absorbing the energy of impact of a falling person.

It is a further object of the invention to develop an impact-absorbing flooring system of modular design which remains rigid under normal usage, but deflects under impact loading. These and other objects and advantages of the invention will become readily apparent from the following description and are particularly delineated in the appended claims.

Advantages of the present invention over the prior art and a better understanding of the invention and its use will become more apparent from the following disclosure in conjunction with the accompanying drawings wherein are set fully by way of illustration and example, certain embodiments of the invention.

DESCRIPTION OF PREFERRED EMBODIMENTS

An impact-absorbing flooring system of modular design is described, with applications in areas of nursing homes where there is a high risk of injury due to falls or in sports facilities for high impact events such as gymnastics and tumbling or with other uses. For example, the invention could also take the form of a safety mat or coaming for use around slippery areas like bathtubs, showers or the edge of swimming pools. The system provides a significant reduction in peak impact load during falls, yet retains a substantially non-compliant configuration during normal motions. The flooring system comprises a series of sections or tiles which can be interconnected to cover the high-risk area. Each tile is composed of a plurality of elastomeric columns sandwiched between two urethane sheets. The top sheet and projecting columns are preferably molded as one piece and then the lower sheet is molded about the free ends of the columns to produce a secure attachment and an integrated unit. The exposed face of the top sheet may optionally be coated with a thin layer of high-friction material and the non-slip properties could be enhanced by incorporation of a knurl pattern.

Figure 1:
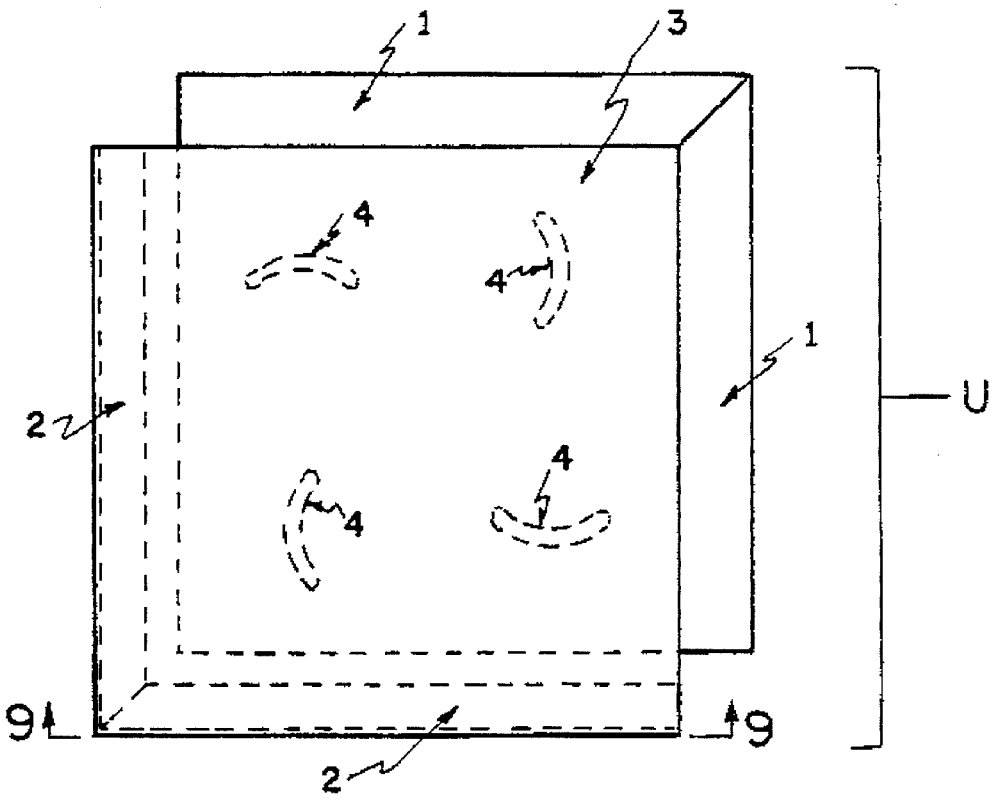
FIG. 1 is a top plan view of the upper plate showing the male joints overhanging on two sides of the plate and the female joints on the opposite sides. The location and orientation of the stiffening columns which protrude from the bottom of the plate are also indicated.

Referring to the drawings in more detail, FIG. 1 shows the upper plate assembly U of one embodiment of the invention where the dual stiffness principle is incorporated into a tile-type structure. A protruding male joint 1 is shown on two adjacent edges while the other two edges are equipped with recessed female joints 2. Both joints are molded into the upper plate of the structure 3. The dashed lines indicate lines that are hidden in this top plan view. The position and orientation of the stiffening columns 4, which protrude from the bottom of the upper plate, can be seen. The orthogonal configuration of this embodiment is apparent, with each column being oriented at 90° to its adjacent neighbors. The slightly curved nature of the columns in top plan view is also visible. All components are formed from urethane and molded together to form the upper plate assembly U. While urethane is a preferred material to construct the system of the invention, other materials having similar physical and chemical characteristics could be utilized.

Figure 2:
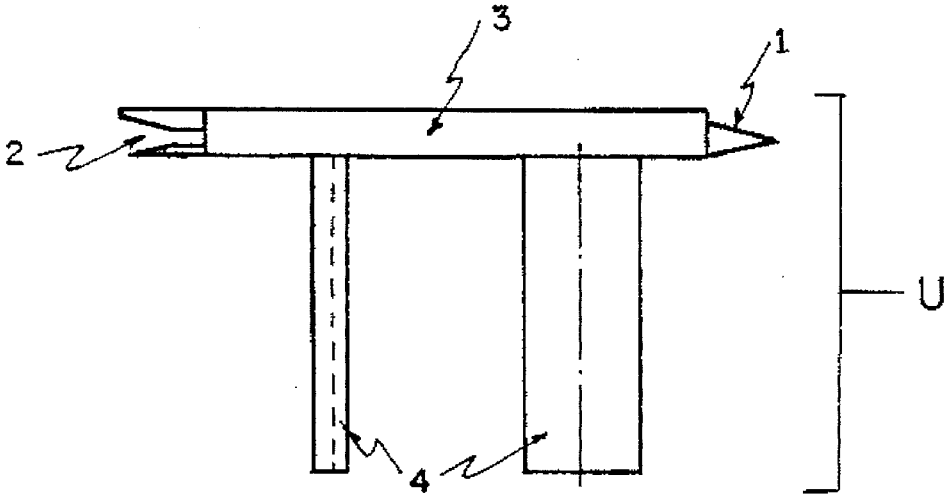
FIG. 2 is a cross-section of the upper plate taken along line 9—9 in FIG. 1 showing the arrangement of the male/female joints and the stiffening columns.

FIG. 2 is a cross-sectional view of the upper plate assembly U. The flexible upper plate 3 can be seen with the male 1 and female 2 joints on opposing sides. The stiffening columns 4 protrude from the bottom of the plate 3 and are at 90° to each other. It should be noted that the pattern of the support columns may be variable. Some of the columns, preferably curved, may be arranged in one direction, and some in another. The support columns should be perpendicular to the top and bottom plates, but do not have to be perpendicular to each other. The support columns could be arranged in one direction, this does not work as well as variable arrangement. Enhanced performance is obtained if all of the columns are not in the same direction.

The modular tile embodiment of the invention may be of convenient floor tile size (i.e., 12 inches by 12 inches) but may vary. The height of the tile may vary but is preferably between one and two inches.

With respect to different applications of the invention having different impact requirements, it is possible to increase the column length and density. The column spacing and dimensions (i.e., thickness, width, length, and arc of curvature) can be adjusted and different materials may be used to accommodate different applications. The columns should be stiff to a certain load and collapse at a higher load. Some small deflection of the flooring may be acceptable in certain applications. As noted, the columns or beams may be curved or straight, but curved are preferred. The columns are a part of or are secured, attached to the top surface plate, and the bottom edges of the columns are preferably securely attached to the lower plate. Holes may be drilled in the bottom plate for attachment or other suitable means known in the art.

Figure 3:
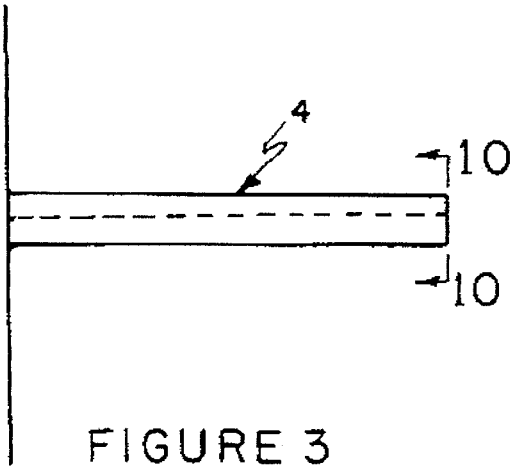
FIG. 3 is a cross-sectional column detail from FIG. 2.
Figure 3A:
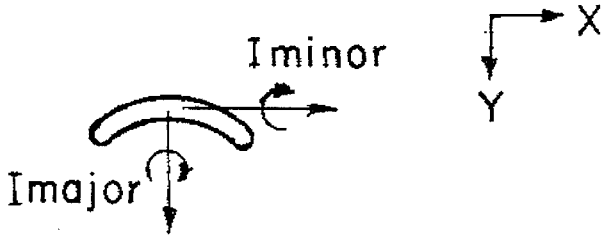
FIG. 3*a* is a cross-sectional view of a column taken along line 10—10 in FIG. 3.

In FIGS. 3 and 3A details of one of the columns from FIG. 2 are illustrated, showing the curved form of the column 4. This slight curve was introduced to the column design because initial tests with flat plane columns indicated that their buckling rigidity under normal loading was highly sensitive to small dimensional defects incorporated into the columns during manufacture. It was found that curved columns had greater buckling load stability and their buckling rigidity was not compromised by these small dimensional defects. Flat plane columns could be utilized in the invention but are not preferred embodiments.

FIG. 3*a* shows the major and minor area moments of inertia, $I_{major}$ and $I_{minor}$ respectively. Stiffness is directly proportional to the area moment of inertia and in this case the stiffness is greater in the x-direction as it is associated with the major area moment of inertia, $I_{major}$. Similarly, stiffness in the y-direction is associated here with the minor area of moment, $I_{minor}$ and therefore the column tends to be less stable in that direction. Since the critical load at which buckling will occur is determined by column length, width, area moment of inertia, material properties and the boundary conditions imposed at the column end points, it is possible to design for a specific critical load by varying some or all of these parameters. Therefore it is possible to configure the invention so that it will remain relatively rigid under normal loading but will buckle under typical impact forces sustained during a fall. Varying the design parameters of the invention will permit construction of multiple embodiments having various uses from private dwellings, bathrooms, geriatric homes to hospitals to athletic events where impact forces are expectedly variable.

Figure 4:
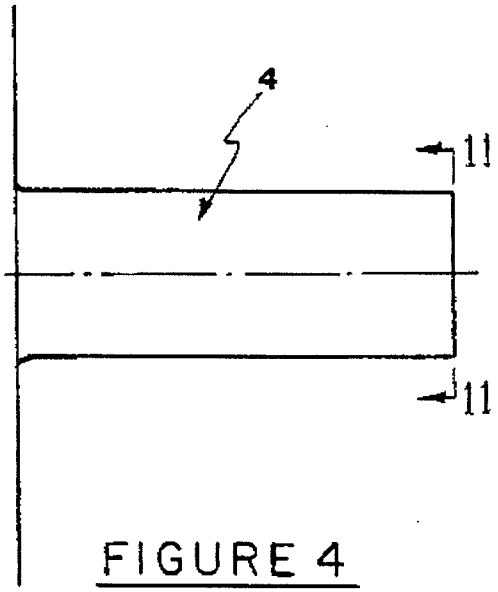
FIG. 4 is a cross-sectional column detail of a column at a 90° orientation to the column in FIG. 3.
Figure 4A:
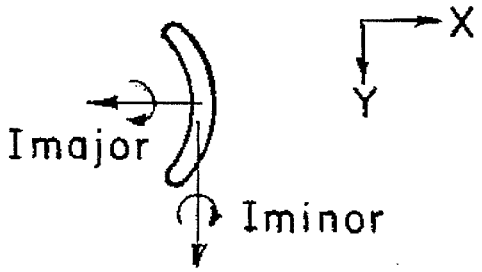
FIG. 4*a* is a cross-sectional view of a column taken along line 11—11 in FIG. 4.

In FIGS. 4 and 4*a* a detail of an adjacent column 4 is shown, which is at 90° to the column in FIGS. 3 and 3*a*. In FIG. 4*a*, the co-ordinate system from FIG. 3*a* is still in use and it can be seen that by turning the column 4 through 90° the orientation of the major and minor areas of moment is also changed. Hence the direction of greater bending stiffness in this case will be the y-direction.

Figure 5:
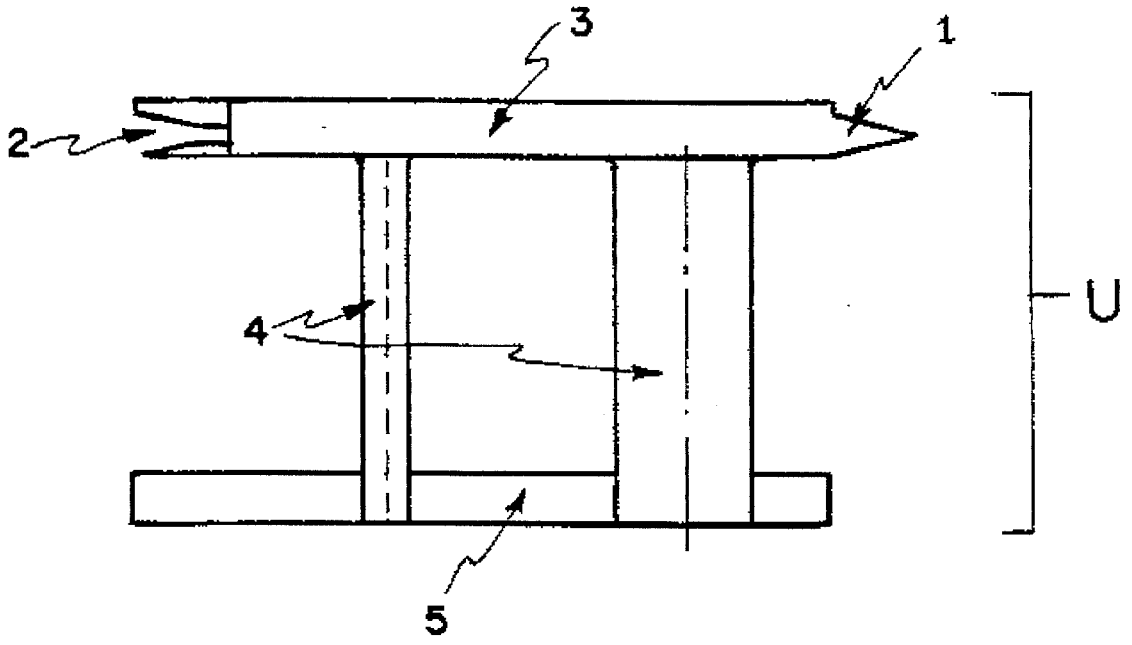
FIG. 5 is a cross-section of the complete assembly showing the upper plate and stiffening columns which are secured to the base plate.

FIG. 5 depicts the complete assembly, where the upper assembly U has been firmly secured to the base plate 5. This is accomplished by casting the base plate 5 around the free ends of the supporting columns 4, thereby integrating the upper plate assembly U with the base plate 5. Note that the mouth of the female joint 2 is in line with the edge of the base plate 5 while the male joint 1 protrudes beyond it. This arrangement ensures a tight fit between adjacent units and eliminates the risk of tripping on gaps between joints.

Figure 6:
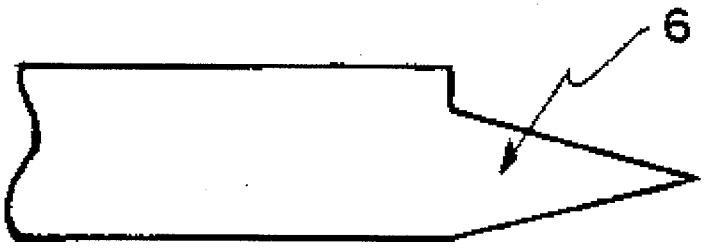
FIG. 6 is a cross-section of the male joint.

FIG. 6 shows the male joint in detail, which is basically a bayonet-type lug 6 that fits snugly into the female joint.

Figure 7:
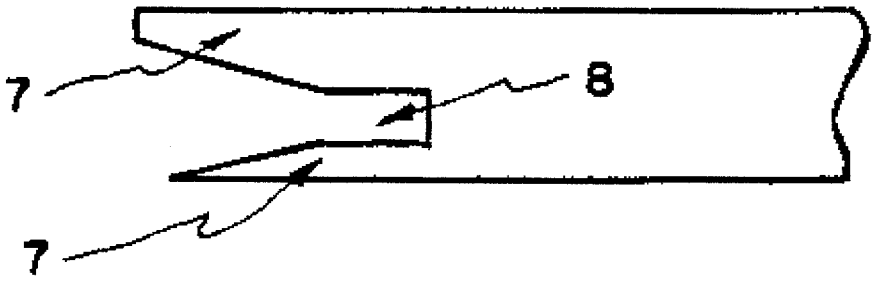
FIG. 7 is a cross-section of the female joint.

In FIG. 7 the female joint is illustrated, clearly showing the two arms 7 which hold the male joint. The squared off area 8 at the back of the female joint allows some room for expansion when the male joint is fully inserted and it also provides space for excess adhesive to accumulate if the tiles are to be more securely joined.

While the methods and compositions herein described constitute preferred embodiments of this invention, it is to be understood that the invention is not limited to these precise methods and compositions, and that various modifications within the scope of the invention will be apparent to those skilled in the art.

Thus is described our invention and the manner and process of making and using it in such full, clear, concise and exact terms so as to enable any person skilled in the an to or with which it pertains, or with which it is most nearly connected, to make and use the same.

What is claimed is:

1. An impact-absorbing flooring system comprising:

(a) an upper surface plate means; and (b) a lower surface plate means; and (c) a plurality of support means extending essentially perpendicularly between and connecting said upper surface plate means and said lower surface plate means, wherein said support means is any structure with essentially two different area moments of inertia and arranged in such a manner that these moments of inertia and associated bending stiffnesses are decoupled so that lateral stability is effected by one area moment of inertia and buckling load is controlled by the other.

2. An impact-absorbing flooring system according to claim 1 wherein said system is a modular tile which is used individually or in combination with other adjoining tiles forming a floor surface.

3. An impact-absorbing flooring system according to claim 1 wherein said plurality of support columns are curved and arranged orthogonally.

4. An impact-absorbing flooring system according to claim 2 wherein said modular tile has a means for connecting said tile to adjacent tiles on said upper plate surface means and optionally on said lower surface plate means.

5. An impact-absorbing flooring system according to claim 4 wherein said means for connecting is male and female joinery.

6. An impact-absorbing flooring system according to claim 5 wherein said upper plate surface means is square and said means for connecting is provided with continuous protruding lugs along two adjacent sides and a continuous recess along the two opposite sides.

7. An impact-absorbing flooring system according to claim 1 wherein said upper surface plate means is flexible and has a plurality of support means of curved plane columns extending from its bottom surface which engage a flexible lower surface plate means.

8. An impact-absorbing flooring system according to claim 7 wherein said upper surface plate means has a textured top surface to provide non-slip properties.

9. An impact-absorbing flooring system according to claim 7 wherein said upper surface plate means has a high-friction coating applied to its top surface to provide non-slip properties.

10. An impact-absorbing flooring system according to claim 7 wherein said curved plane columns are elastomeric and said upper surface plate means and said lower surface plate means are urethane sheets.

* * * * *